US008500415B2

(12) United States Patent
Taguchi

(10) Patent No.: US 8,500,415 B2
(45) Date of Patent: Aug. 6, 2013

(54) VARIABLE DISPLACEMENT COMPRESSOR

(75) Inventor: Yukihiko Taguchi, Maebashi (JP)

(73) Assignee: Sanden Corporation, Gunma (JP)

( * ) Notice: Subject to any disclaimer, the term of this patent is extended or adjusted under 35 U.S.C. 154(b) by 577 days.

(21) Appl. No.: 12/680,846

(22) PCT Filed: Oct. 1, 2008

(86) PCT No.: PCT/JP2008/067851

§ 371 (c)(1),
(2), (4) Date: Mar. 30, 2010

(87) PCT Pub. No.: WO2009/044781

PCT Pub. Date: Apr. 9, 2009

(65) Prior Publication Data

US 2010/0215514 A1 Aug. 26, 2010

(30) Foreign Application Priority Data

Oct. 2, 2007 (JP) ..... 2007-258659

(51) Int. Cl.
*F04B 1/26* (2006.01)

(52) U.S. Cl.
USPC ..... 417/222.2; 417/270

(58) Field of Classification Search
USPC ..... 417/222.2, 270
See application file for complete search history.

(56) References Cited

U.S. PATENT DOCUMENTS

| | | | | |
|---|---|---|---|---|
| 2002/0094278 | A1 * | 7/2002 | Fukanuma et al. | 417/222.2 |
| 2003/0035733 | A1 | 2/2003 | Hirota | |
| 2003/0044289 | A1 | 3/2003 | Matsuda et al. | |
| 2003/0044291 | A1 * | 3/2003 | Umemura et al. | 417/222.2 |
| 2003/0210988 | A1 * | 11/2003 | Hirota | 417/222.2 |
| 2006/0045758 | A1 * | 3/2006 | Hirota | 417/222.2 |

FOREIGN PATENT DOCUMENTS

| | | |
|---|---|---|
| JP | 6-341378 | 12/1994 |
| JP | 2001-193640 | 7/2001 |
| JP | 2002-285973 | 10/2002 |
| JP | 2003-83244 | 3/2003 |

* cited by examiner

*Primary Examiner* — Charles Freay
(74) *Attorney, Agent, or Firm* — Cozen O'Connor

(57) ABSTRACT

A displacement control valve for a variable displacement compressor includes a valve element. The valve element has a discharge pressure receiving surface which receives pressure in a discharge chamber and a suction pressure receiving surface which receives pressure in a suction pressure section acting in a direction opposite to the direction that the pressure in the discharge chamber acts on the discharge pressure receiving surface. The displacement control valve also includes a solenoid generating generates an electromagnetic force acting on the valve element, and a urging means urging on urges the valve element in a valve closing direction to hold the valve element in a valve closing position when the generated electromagnetic force generated by the solenoid is not acting on the valve element.

2 Claims, 5 Drawing Sheets

VARIABLE DISPLACEMENT COMPRESSOR

RELATED APPLICATIONS

This is a U.S. National Phase under 35 U.S.C. §371 of International Application No. PCT/JP2008/067851, filed on Oct. 1, 2008 and claims priority on Japanese Patent Application No. 2007-258659, filed on Oct. 2, 2007, the entire content of which is hereby incorporated by reference.

TECHNICAL FIELD

This invention relates to a variable displacement compressor used in an automotive air conditioning system.

BACKGROUND ART

A variable displacement reciprocating compressor used in an automotive air conditioning system, for example, has a housing, and inside the housing, a discharge chamber, a suction chamber, a crank chamber and cylinder bores are defined. On a drive shaft extending inside the crank chamber, a swashplate is mounted to be variable in inclination, and a conversion mechanism including the swashplate converts rotation of the drive shaft into reciprocating motion of pistons fitted within the respective cylinder bores. By the reciprocating motion, each piston performs a discharge process of drawing a working fluid from the suction chamber into its own cylinder bore, compressing the drawn-in working fluid and discharging the compressed working fluid to the discharge chamber.

The length of the stroke of the piston, therefore, the displacement of the compressor can be varied by varying pressure in the crank chamber (control pressure). In order to control the displacement, a displacement control valve is arranged in a gas supply passage connecting the discharge chamber and the crank chamber, and a restriction is provided between the crank chamber and the suction chamber.

In the displacement control valve, as disclosed in document 1 (Japanese Patent Application KOKAI Publication 2002-285973), for example, by controlling activation of a solenoid depending on the operating state of an engine, etc., a valve element is moved to open or close the valve. By this, supply of a working fluid from a discharge chamber to a crank chamber is controlled, so that the displacement of the compressor is varied.

For the displacement control valve shown in FIG. 2 of document 1, the relationship among forces acting on the valve element 25 is represented by equation (1) below. Equation (1) can be rearranged into equation (2) giving an acting pressure difference ΔP (difference between discharge pressure Pd and suction pressure Ps). Here, Sv is the area of that surface of the valve element which receives the discharge pressure, Pd is the discharge pressure, Ps is the suction pressure, f1 is a force exerted by a compression coil spring 28, f2 is a force exerted by a compression coil spring 27, and F(I) is an electromagnetic force generated by a solenoid supplied with a control current I. It is arranged that f1 and f2 satisfy a relationship f1>f2.

$$Sv\cdot(Pd-Ps)+f1-f2-F(I)=0 \tag{1}$$

$$\Delta P=Pd-Ps=\frac{1}{Sv}\cdot F(I)-\frac{f1-f2}{Sv} \tag{2}$$

Provided that the solenoid is designed to generate the electromagnetic force represented by F(I)=A·I (A is a coefficient), equation (2) can be rewritten into equation (3) below. FIG. 6 shows the graph of equation (3).

$$\Delta P=Pd-Ps=\frac{A}{Sv}\cdot I-\frac{f1-f2}{Sv} \tag{3}$$

FIG. 6 shows that the acting pressure difference ΔP, namely Pd−Ps is in proportion to control current, and that a maximum acting pressure difference ΔPmax requires a maximum value Imax of control current. The acting pressure difference ΔP thus varies from 0 to ΔPmax as the control current is regulated in the range of 0 to Imax.

Provided that Imin represents a control current value at which Pd−Ps becomes 0, Imin=(f1−f2)/A is derived from equation (3). Since f1>f2, the valve element stays in an open position for values 0 to Imin of control current I. In order for the displacement control valve to function, supply of control current I of Imin or greater is required. In sum, the arrangement that the force resulting from the two compression coil springs and the electromagnetic force generated by the solenoid act in opposite directions does not allow effective use of the electromagnetic force generated by the solenoid, from the control current value 0.

Further, Imin being not 0 leads to a great gradient of the acting pressure difference ΔP varying depending on the current, which means a slight variation in control current I results in a significant variation in Pd−Ps.

Further, the great gradient of the acting pressure difference varying depending on the current means that the coefficient A/Sv of the current I in equation (3) needs to be great in order to achieve the maximum acting pressure difference ΔPmax. This requires that Sv be small. Sv is the area of the surface which receives the discharge pressure, and at the same time the area of the surface which receives the suction pressure. Smaller area Sv results in lower sensitivity of the valve element responding to variations in discharge pressure or suction pressure, which may impair the stability of displacement control.

DISCLOSURE OF THE INVENTION

An object of the present invention is to provide a variable displacement compressor provided with a displacement control valve designed to make effective use of an electromagnetic force generated by a solenoid and superior in control stability.

In order to achieve the above object, there is provided, as an embodiment of the present invention, a variable displacement compressor comprising a housing with a discharge pressure section, a suction pressure section, a crank chamber and cylinder bores defined inside, pistons fitted in the respective cylinder bores, a drive shaft rotatably supported inside the housing, a conversion mechanism including a swashplate variable in inclination and converting rotation of the drive shaft into reciprocating motion of the pistons, a displacement control valve opening and closing a first connection passage connecting the discharge pressure section and the crank chamber, and a restriction provided in a second connection passage connecting the crank chamber and the suction pressure section, where the stroke of the pistons is regulated by regulating the extent to which the displacement control valve is opened, thereby varying pressure in the crank chamber, wherein the displacement control valve includes a valve element having a discharge pressure receiving surface which receives pressure in the discharge pressure section and a suction pressure receiving surface which receives pressure in the suction pressure section acting in a direction opposite to the direction that the pressure in the discharge pressure section acts on the discharge pressure receiving surface, a solenoid generating an electromagnetic force acting on the valve element, and a urging means urging on the valve element in a valve closing direction to hold the valve element in a valve closing position when the electromagnetic force generated by the solenoid is not acting on the valve element.

In this embodiment of the variable displacement compressor, when the solenoid of the displacement control valve ceases to be excited, so that the electromagnetic force generated by the solenoid becomes zero, the valve element is brought into the valve closing position. This means that the displacement is controlled by making effective use of the electromagnetic force generated by the solenoid from the value 0.

This leads to a reduced gradient of the acting pressure difference varying depending on the current, and therefore provides improved stability of control of the acting pressure difference by varying the current. Further, the extended range of control of the electromagnetic force allows the valve element to have an increased pressure receiving surface area, resulting in improved stability of displacement control.

In a preferred embodiment, when the electromagnetic force generated by the solenoid is not acting on the valve element, the first connection passage is opened or closed by the displacement control valve so as to maintain a pressure difference between the pressure in the discharge pressure section acting on the discharge pressure receiving surface and the pressure in the suction pressure section acting on the suction pressure receiving surface at a set value determined depending on a urging force exerted by the urging means.

In this preferred embodiment of the variable displacement compressor, even while the solenoid is not excited, the displacement is autonomously controlled on the basis of the set value of the pressure difference determined depending on the urging force exerted by the urging means.

In a preferred embodiment, the variable displacement compressor is a clutchless compressor having a check valve arranged in the discharge pressure section, the check valve opens when a pressure difference across the check valve exceeds a set value and stays closed while the pressure difference is at or below the set value, and said set value of the pressure difference determined depending on the urging force exerted by the urging means is less than the set value of the pressure difference across the check valve.

In this preferred embodiment of the variable displacement compressor, while the solenoid is not excited, the refrigerant is not discharged from the compressor. Thus, in an air conditioning system to which this variable displacement compressor is applied, while the solenoid is not excited, the refrigerant does not circulate inside the air conditioning system, so that an evaporator is prevented from freezing.

In a preferred embodiment, the electromagnetic force generated by the solenoid acts on the valve element in the valve closing direction.

In this preferred embodiment of the variable displacement compressor, when the control current supplied to the solenoid is zero, the acting pressure difference takes a minimum value, and as the control current is increased from 0, the acting pressure difference increases. This variable displacement compressor is therefore suited to be a clutchless compressor.

In a preferred embodiment, the variable displacement compressor is provided with an electromagnetic clutch, the electromagnetic force generated by the solenoid acts on the valve element in a valve opening direction, and said pressure difference between the pressure in the discharge pressure section acting on the discharge pressure receiving surface and the pressure in the suction pressure section acting on the suction pressure receiving surface takes a maximum value when the electromagnetic force generated by the solenoid is not acting on the valve element.

In this preferred embodiment of the variable displacement compressor, when the control current supplied to the solenoid is zero, the acting pressure difference takes a maximum value, and as the control current is increased from 0, the acting pressure difference reduces.

This variable displacement compressor is therefore suited to be provided with an electromagnetic clutch.

BRIEF DESCRIPTION OF THE DRAWINGS

The present invention will be well understood from the following detailed description and the accompanying drawings, which are given by way of illustration only, and thus, are not limitative of this invention, and wherein.

EXPLANATION OF REFERENCE CHARACTERS

Figure 1:
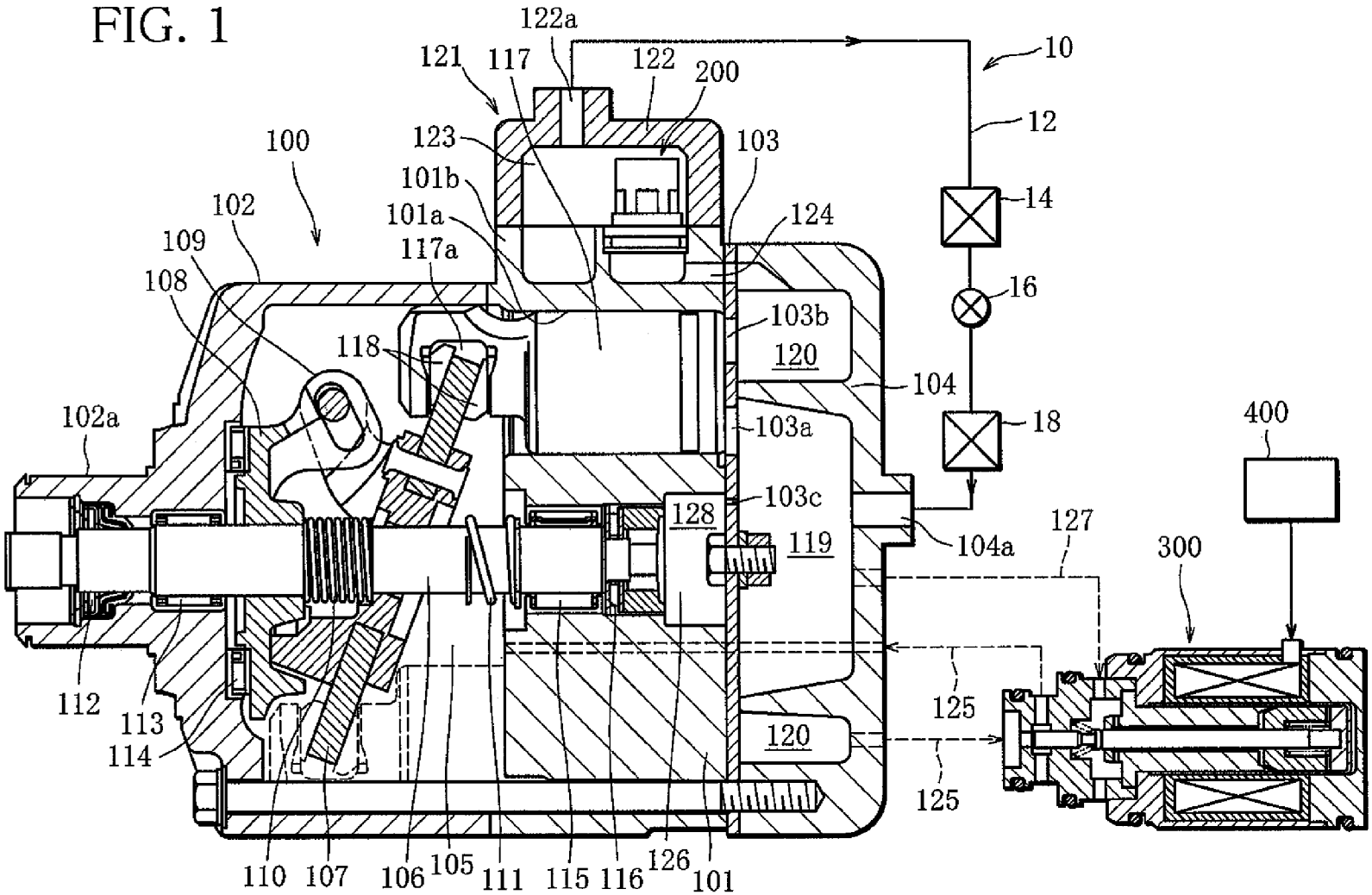
FIG. 1 is a diagram showing the schematic structure of a refrigeration cycle of an automotive air conditioning system, with a vertical cross-section of an embodiment of a variable displacement compressor.

100: Compressor
300, 350: Displacement control valve
101: Cylinder Block
102: Front Housing
117: Piston
106: Drive shaft
107: Swashplate
103*c*: Fixed orifice
302, 352: Valve element
316, 357: Molded coil
314, 355: Compression coil spring

BEST MODE FOR CARRYING OUT THE INVENTION

FIG. 1 shows the schematic structure of a refrigeration cycle of an automotive air conditioning system, with a vertical cross-section of a variable displacement compressor.

The refrigeration cycle 10 of the automotive air conditioning system has a circulation line 12 in which a refrigerant (R134a, for example) as a working fluid circulates. In the circulation line 12, a variable displacement compressor (hereinafter referred to simply as "compressor 100"), a radiator (condenser) 14, an expansion device (expansion valve) 16 and an evaporator 18 are arranged serially in the direction of flow of the refrigerant. The compressor 100 performs a process of drawing the refrigerant in, compressing the drawn-in refrigerant and discharging the compressed refrigerant, thereby forcing the refrigerant to circulate in the circulation line 12.

The evaporator 18 constitutes also a part of an air circuit of the automotive air conditioning system. Air passing across the evaporator 18 is cooled by the refrigerant taking heat to evaporate within the evaporator 18.

The compressor 100 is a variable displacement clutchless swashplate compressor, and comprises a cylinder block 101 having a plurality of cylinder bores 101*a*, a front housing 102 joined to an end of the cylinder block 101, and a rear housing 104 joined to the other end of the cylinder block 101 with a valve plate 103 interposed between.

The cylinder block 101 and the front housing 102 define a crank chamber 105, and a drive shaft 106 extends axially across the interior of the crank chamber 105. The drive shaft 106 extends through an annular swashplate 107 arranged inside the crank chamber 105, and the swashplate 107 is hinged to a rotor 108 fixed on the drive shaft 106, by a joint 109. The swashplate 107 can therefore vary in inclination, while moving along the drive shaft 106.

A coil spring 110 is mounted on the drive shaft 106, between the rotor 108 and the swashplate 107, to exert a force tending to force the swashplate 107 to take a minimum inclination angle. On the other side of the swashplate 107, namely between the swashplate 107 and the cylinder block 101, a coil spring 111 is mounted on the drive shaft 106 to exert a force tending to force the swashplate 107 to take a maximum inclination angle.

The drive shaft 106 extends through a boss 102*a* projecting outward from the front housing 102, so that the end of the drive shaft is located outside the boss. A shaft sealing device 112 is inserted between the drive shaft 106 and the boss 102*a*. The sealing device 112 seals the front housing 102. The drive shaft 106 is rotatably supported by bearings 113, 114, 115 and 116 in its radial and thrust directions. Drive force is transmitted from an external drive source such as an engine to the end of the drive shaft 106 projecting beyond the boss 102*a*, so that the drive shaft is driven to rotate.

A piston 117 is fitted within each cylinder bore 101*a*. The piston 117 has an integrally-formed tail portion projecting into the crank chamber 105. In a recess 117*a* in the tail portion, a pair of shoes 118 is provided. The shoes 118 are in sliding contact with the periphery of the swashplate 107 on both sides thereof. Thus, the shoes 118 enable the piston 117 and the swashplate 107 to move in conjunction with each other, thereby enabling rotation of the drive shaft 106 to be converted into reciprocating motion of the piston 117 within its own cylinder bore 101*a*. The shoes 118 therefore constitute a conversion mechanism converting the rotation of the drive shaft 106 into the reciprocating motion of the piston 117.

The rear housing 104 defines a suction chamber 119 and a discharge chamber 120. The suction chamber 119 is connected to the cylinder bores 101*a* by a suction hole 103*a* in the valve plate 103. The discharge chamber 120 is connected to the cylinder bores 101*a* by a discharge hole 103*b* in the valve plate 103. The suction hole 103*a* and the discharge hole 103*b* are opened and closed by a suction valve and a discharge valve, not shown, respectively.

A muffler 121 is provided outside the cylinder block 101. The cylinder block 101 has an integrally-formed muffler base 101*b*. A muffler casing 122 constituting the muffler 121 is joined to the muffler base 101*b* with a sealing member, not shown, interposed between. The muffler casing 122 and the muffler base 101*b* define a muffler space 123, and the muffler space 123 is connected to the discharge chamber 120 by a discharge passage 124 which extends in the wall of the rear housing 104, then through the valve plate 103 and then through the wall of the muffler base 101*b*.

The muffler casing 122 has a discharge port 122*a*, and a check valve 200 is provided in the muffler space 123 to block a flow between the discharge passage 124 and the discharge port 122*a*. Specifically, the check valve 200 opens or closes depending on a pressure difference between the discharge passage 124 and the muffler space 123; the check valve 200 closes when the pressure difference becomes smaller than or equal to a set value ΔPset, and opens when the pressure difference becomes greater than the set value ΔPset.

The discharge chamber 120 is connected to the outgoing side of the circulation line 12 by the discharge passage 124, the muffler space 123 and the discharge port 122*a*, where the check valve 200 allows or blocks a flow to the muffler space 123. The suction chamber 119 is connected to the incoming side of the circulation line 12 by a suction port 104*a* in the rear housing 104.

A displacement control valve 300 is connected to the rear housing 104. Specifically, the displacement control valve 300 is provided in a gas supply passage 125 (first connection passage). The gas supply passage 125 extends through the wall of the rear housing 104, the valve plate 103 and the cylinder block 101, thereby connecting the discharge chamber 120 and the crank chamber 105.

The suction chamber 119 is connected to the crank chamber 105 by a gas release passage 126 (second connection passage). The gas release passage 126 consists of clearances between the drive shaft 106 and the respective bearings 115, 116, a space 128 and a fixed orifice 103*c* (restriction) in the valve plate 103.

The suction chamber 119 is connected to the displacement control valve 300 by a pressure sensing passage 127 extending through the wall of the rear housing 104, independently of the gas supply passage 125.

Figure 2A:
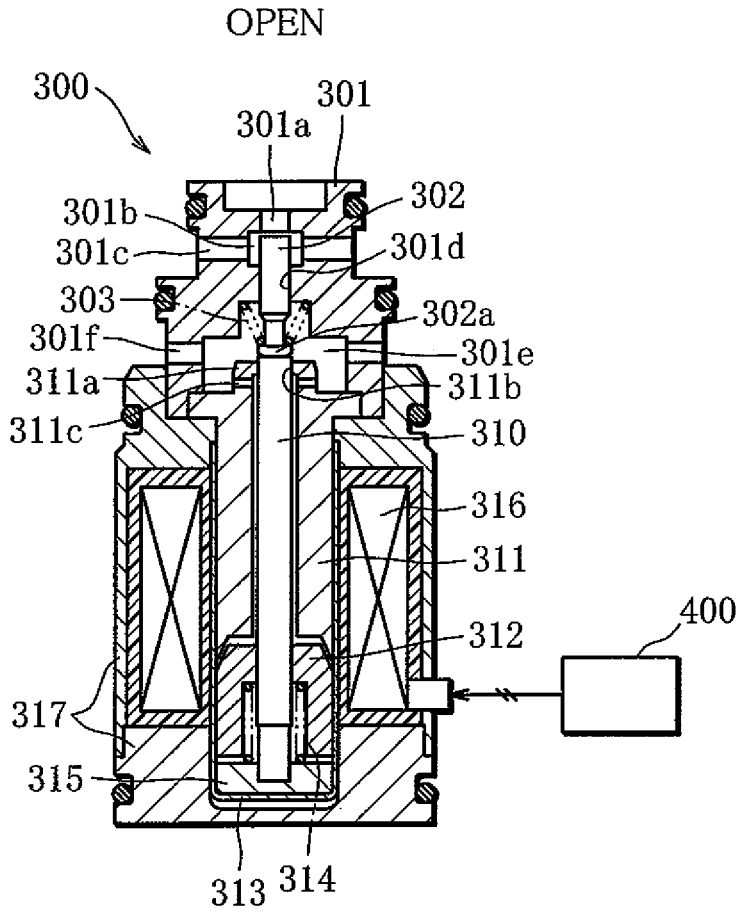
FIG. 2A is a cross-sectional view showing the whole structure of a displacement control valve of a first embodiment, in an open state.
Figure 2B:
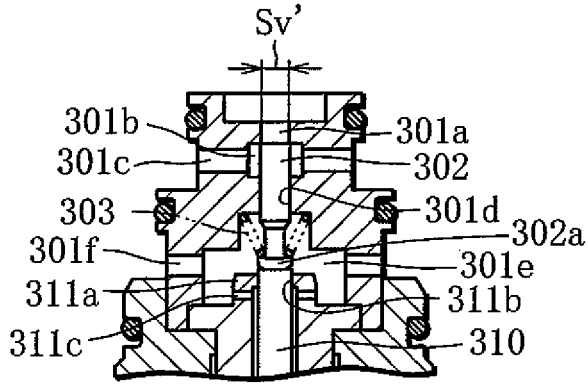
FIG. 2B is a cross-sectional view partly showing the structure of the displacement control valve of the first embodiment, in a closed state.

FIGS. 2A and 2B show the structure of a displacement control valve 300 in a first embodiment of the present invention. Specifically, FIG. 2A is a cross-sectional view showing the whole valve in an open state, while FIG. B is a cross-sectional view partly showing the valve in a closed state.

As shown in FIG. 2A, the displacement control valve 300 consists of a valve unit and a drive unit (solenoid) opening and closing the valve unit. The valve unit includes an approximately cylindrical valve housing 301, and inside the valve housing 301, a valve chamber 301*b* and a pressure sensing chamber 301*e* are defined to be in line along the axis of the valve housing 301.

The valve housing 301 has a connection hole 301*c* and a connection hole 301*f* in the cylindrical wall, and a valve hole 301*a* at an end. The valve chamber 301*b* is connected to the discharge chamber 120 by the valve hole 301*a* and the upstream side of the gas supply passage 125, and to the crank chamber 105 by the connection hole 301*c* and the downstream side of the gas supply passage 125. The pressure sensing chamber 301*e* is connected to the suction chamber 119 by the connection hole 301*f* and the pressure sensing passage 127.

An insertion hole 301*d* is provided through the center of the valve housing 301. The insertion hole 301*d* extends between the valve chamber 301*b* and the pressure sensing chamber 301*e* along the axis of the valve housing 301. A valve element 302 is inserted in the insertion hole 301*d*. The valve element 302 is thus slidably arranged inside the valve housing 301.

A first end of the valve element 302 is located in the valve chamber 301*b*, while the opposite, second end is located in the pressure sensing chamber 301*e*. The valve element 302 opens and closes the valve hole 301*a* at the first end side, thereby opening and closing the gas supply passage 125.

A compression coil spring 303 is arranged in the pressure sensing chamber 301*e*. Specifically, the compression coil spring 303 is arranged with a first end butted against the inner wall surface of the pressure sensing chamber 301*e* and the opposite, second end butted against a stepped portion 302*a* of the valve element 302 to push on the valve element 302 in a valve opening direction.

The solenoid comprises a solenoid rod 310, a fixed core 311, a movable core 312, a tubular member 313, a compression coil spring 314, a support member 315, a molded coil 316 and a solenoid housing 317.

The solenoid housing 317 is approximately cylindrical in shape and coaxially joined to the valve housing 301. The fixed core 311 is approximately cylindrical in shape and arranged inside the solenoid housing 317. The solenoid rod 310 is inserted in the fixed core 311.

The solenoid rod 310 is arranged with a first end butted against the valve element 302 and the opposite, second end projecting beyond the fixed core 311. The second-end-side projecting portion of the solenoid rod 310 is passed through the movable core 31 approximately cylindrical in shape so that the movable core 312 is fixed on the solenoid rod 310. The movable core 312 faces the fixed core 311 with a predetermined space between.

The tubular member 313 is fixed inside the solenoid housing 317 to enclose the movable core 312, the compression coil spring 314 and the support member 315 as well as part of the solenoid rod 310 and part of the fixed core 311. The support member 315 is approximately in the shape of a disc and arranged inside the tubular member 313 such that the movable core 312 is sandwiched between the support member and the fixed core 311.

The compression coil spring 314 is arranged between the support member 315 and the movable core 312 to push on the movable core 312 toward the valve housing 301, and thus, push on the solenoid rod 310 and the valve element 302 in a valve closing direction.

The fixed core 311 has a projecting portion 311*a*. The projecting portion 311*a* has an insertion hole 311*b* to allow the solenoid rod 310 to pass through. A connection hole 311*c* connects the space holding the movable core 312 to the pressure sensing chamber 301*e*. The solenoid rod 310 is arranged with a first end portion passed through the insertion hole 311*b* and the opposite second end on the support member 315, to be movable along the axis. It is arranged such that the outer circumferential surface of the movable core 312 does not touch the inner circumferential surface of the tubular member 313.

The movable core 312, the fixed core 311 and the solenoid housing 317 are each made of a magnetic material and constitute a magnetic circuit. The tubular member 313 is made of a stainless-based nonmagnetic material.

A control device 400 provided outside the compressor 100 is connected to the molded coil 314. Supplied with a control current I from the control device 400, the solenoid including the molded coil 314 generates an electromagnetic force F(I). The electromagnetic force F(I) generated by the solenoid attracts the movable core 312 toward the fixed core 310, thus acts on the valve element 302 in the valve closing direction.

In the displacement control valve 300, pressure in the discharge chamber 120 (discharge pressure Pd) acts on the first end of the valve element 302, while pressure in the suction chamber (suction pressure Ps) acts on the second end of the valve element 302. The valve element 302 thus functions also as a pressure sensing member moving in response to an acting pressure difference ΔP, namely pressure difference between the discharge pressure Pd and the suction pressure Ps.

As shown in FIG. 2B, it is arranged such that the area of the pressure receiving surface of the valve element 302 on which the discharge pressure Pd acts when the valve hole 301*a* is closed by the valve element 302 (sealing surface area) is approximately equal to the cross-sectional area of that portion of the valve element 302 which extends through the insertion hole 301*d* and is subjected to the suction pressure Ps. Consequently, pressure in the crank chamber 105 (crank pressure Pc) does not act on the valve element 302 in the valve opening or closing direction. The relationship among forces acting on the valve element 302 is therefore represented by equation (4) below. Equation (4) can be rearranged into equation (5) giving the acting pressure difference ΔP.

$$Sv' \cdot (Pd - Ps) + f3 - f4 - A \cdot I = 0 \tag{4}$$

$$\Delta P = Pd - Ps = \frac{A}{Sv'} \cdot I + \frac{f4 - f3}{Sv'} \tag{5}$$

In equations (4) and (5), Sv' is the area of that surface of the valve element 302 which receives the discharge pressure Pd (=area of the surface receiving the suction pressure), f3 is the force exerted by the compression coil spring 303, f4 is the force exerted by the compression coil spring 314, and A·I is the electromagnetic force generated by the solenoid. A is a constant, and the solenoid is designed to generate the electromagnetic force in proportion to the control current I.

It is arranged that the force f3 exerted by the compression coil spring 303 is slightly less than the force f4 exerted by the compression coil spring 314, so that f3−f4<O. Consequently, when the electromagnetic force generated by the solenoid is 0, the valve element 302 is forced to close the valve hole 301*a* by the compression coil spring 314.

Figure 3:
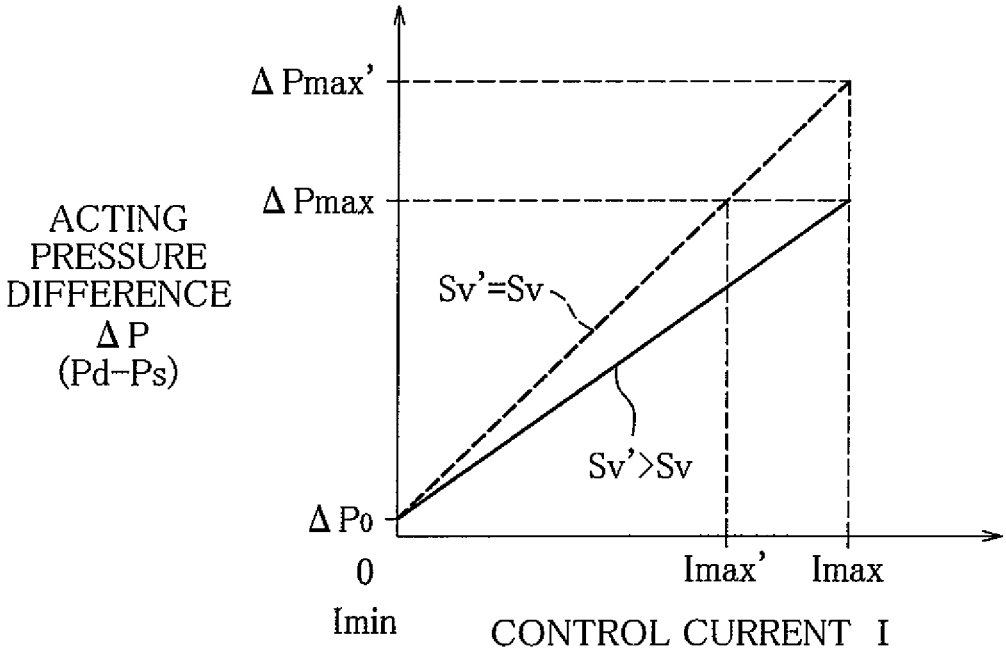
FIG. 3 is a graph showing a relationship between control current and acting pressure difference for the first embodiment.

FIG. 3 is the graph showing the relationship between the control current I and the acting pressure difference ΔP represented by equation (5). In FIG. 3, the relationship for the case in which Sv'=Sv, i.e., the pressure receiving surface area does not differ from that in the prior art is plotted in broken line. In this case, the maximum acting pressure difference ΔPmax for the prior art is achieved by a control current value Imax' less than the control current value Imax in the prior art, resulting in a reduction in power consumption.

Further, the maximum control current value Imax for the prior art brings about a maximum acting pressure difference ΔPmax' in the present case, which is greater than the maximum acting pressure difference ΔPmax that the same control current value brings about in the prior art.

Further, if it is intended that the maximum control current value Imax brings about a maximum acting pressure difference ΔPmax as the graph plotted in solid line in FIG. 3 shows, the discharge pressure Pd receiving surface area Sv' of the valve element 302 is allowed to be greater than Sv. This results in higher sensitivity in responding to variations in acting pressure difference ΔP, namely difference between the discharge pressure Pd and the suction pressure Ps, and thus, provides improved control stability.

Next, how the compressor 100 is controlled by the displacement control valve 300 will be described.

First, control of the compressor 100 operating at a predetermined rotation speed with the solenoid not being supplied with current, thus not being excited will be described. The operating characteristic formula for the displacement control valve 300 in this case is equation (6) below representing the minimum acting pressure difference ΔP0.

$$P0=Pd-Ps=(f4-f3)/Sv' \quad (6)$$

Thus, when the acting pressure difference ΔP exceeds the minimum acting pressure difference ΔP0, the valve element 302 moves to open the valve, namely allow a flow from the discharge chamber 120 to the crank chamber 125 via the connection passage 125, so that the discharged gas is introduced to the crank chamber 105. Since the fixed orifice 103*c* restricts the flow from the crank chamber 105 to the suction chamber 119, the discharged gas entering the crank chamber 105 causes an increase in crank pressure Pc, and thus a reduction in inclination angle of the swashplate 107, and therefore, a reduction in displacement.

When the displacement reduces so that the acting pressure difference ΔP decreases to or below the minimum acting pressure difference ΔP0, the valve element 302 moves in the valve closing direction to restrict the flow from the discharge chamber 120 to the crank chamber 105, so that the amount of the discharged gas introduced to the crank chamber 105 reduces. This results in a decrease in crank pressure Pc, and thus an increase in inclination angle of the swashplate 107, and therefore an increase in displacement.

By the process described above, even with the solenoid not being supplied with current, the displacement is autonomously controlled to maintain the acting pressure difference ΔP at the minimum acting pressure difference ΔP0. As seen from equation (6), the minimum acting pressure difference ΔP0 is determined by the compression coil spring 303, the compression coil spring 314 and the discharge pressure Pd receiving surface area Sv' of the valve element 302. In other words, the minimum acting pressure difference ΔP0 is determined depending on the urging force which the urging means exerts on the valve element 302 in the valve closing direction.

Next, control of the compressor with the solenoid being supplied with current, thus being excited will be described. In this case, the acting pressure difference ΔP is optionally varied by regulating the control current supplied to the solenoid, and the displacement is controlled to maintain the acting pressure difference ΔP at a desired value. For example, through the control device 400 regulating the control current I to bring the evaporator-outlet air temperature closer to a target thereof, the displacement is autonomously controlled to achieve a desired air-conditioned state.

In the present embodiment, particularly, even with the solenoid not being excited, the displacement is autonomously controlled, which means that the electromagnetic force generated by the solenoid is made effective use of, from the value 0.

The minimum acting pressure difference ΔP0 is set to be less than the pressure difference ΔPset set for the check valve 200 to open. Consequently, while the displacement of the compressor 100 is being controlled to maintain the acting pressure difference at the minimum acting pressure difference ΔP0, the check valve 200 does not open but stays closed. The discharged refrigerant therefore does not circulate in the circulation line 12 of the air conditioning system but circulates inside the compressor 100, which prevents the evaporator 18 from freezing. Thus, with the solenoid not being excited, the compression coil spring 314's urging on the valve element 302 in the valve closing direction does not entail a problem.

Figure 4:
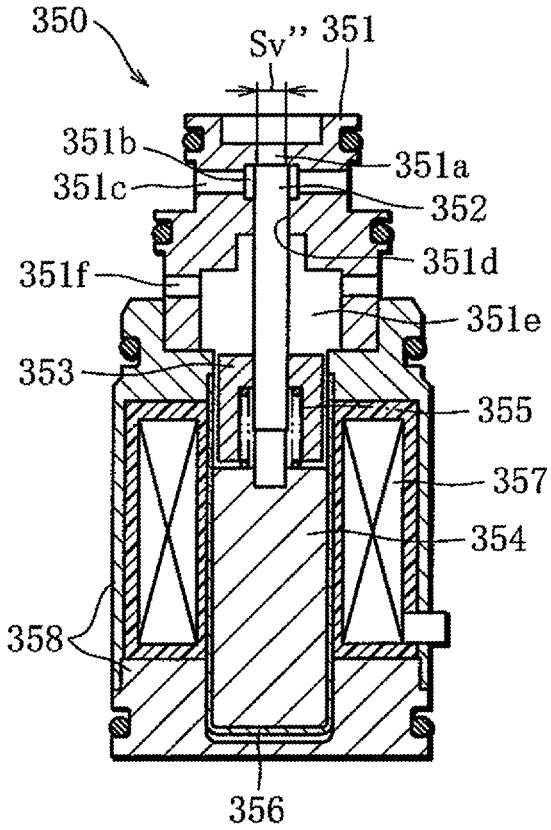
FIG. 4 is a cross-sectional view showing the structure of a displacement control valve of a second embodiment.

FIG. 4 is a cross-sectional view showing the structure of a displacement control valve 350 in a second embodiment of the present invention.

The valve housing 351 of the displacement control valve 350 in the present embodiment has a valve hole 351*a* connected to the discharge chamber 120, a valve chamber 351*b* in which a first end of a valve element 352 is located, and a connection hole 351*c* connected to the crank chamber 105. The valve element 352 slidably extends through an insertion hole 351*d*, and further extends through a pressure sensing chamber 351*e* to which the insertion hole 351*d* connects, at a second end side opposite to the aforementioned first end of the valve element 352. The pressure sensing chamber 351*e* is connected to the suction chamber 119 via a connection hole 351*f*.

The valve element 352 is pressed into a movable core 353 at the second end side, so that the movable core 353 is fixed on the valve element 352. The valve element 352 thus extends through the movable core 353, and the second end portion of the valve element 352 is slidably received in a support, hole of the fixed core 354. The unit consisting of the valve element 352 and the movable core 353 integrally combined is pushed on in a valve closing direction by a compression coil 355 arranged between the movable core 353 and the fixed core 354.

The fixed core 354 is arranged to face the movable core 353 with a predetermined space between, and a tubular member 356 is arranged to enclose the fixed core 356 and the movable core 353. A molded coil 357 is arranged to surround the tubular member 356, and the solenoid housing 351 surrounds the molded coil 357.

The movable core 353, the fixed core 354 and the solenoid housing 358 are each made of a magnetic material and constitute a magnetic circuit. The tubular member 356 is made of a stainless-based nonmagnetic material.

The valve element 352 is arranged to extend through the insertion hole 351*d* at the first end side, and be received in the fixed core 354 at the second end side. It is arranged such that the outer circumferential surface of the movable core 353 does not touch the inner circumferential surfaces of the tubular member 356 and the solenoid housing 358. The valve housing 351 is pressed into the solenoid housing 258 at an end, thereby fixed to the end of the solenoid housing, so that the valve housing and 351 and the solenoid housing 358 are integrally combined to form a displacement control valve 350.

In the displacement control valve 350 structured as described above, the relationship among forces acting on the valve element 352 is represented by equation (7) below. Equation (7) can be rearranged into equation (8) giving acting pressure difference ΔP. Here, Sv" is the area of that surface of the valve element 352 which receives discharge pressure Pd (=area of the surface receiving suction pressure), f5 is a force exerted by the compression coil spring 355, and A·I is an electromagnetic force generated by the solenoid, where A is a constant.

$$Sv'' \cdot (Pd - Ps) - f5 + A \cdot I = 0 \quad (7)$$

$$\Delta P = Pd - Ps = -\frac{A}{Sv''} \cdot I + \frac{f5}{Sv''} \quad (8)$$

Figure 5:
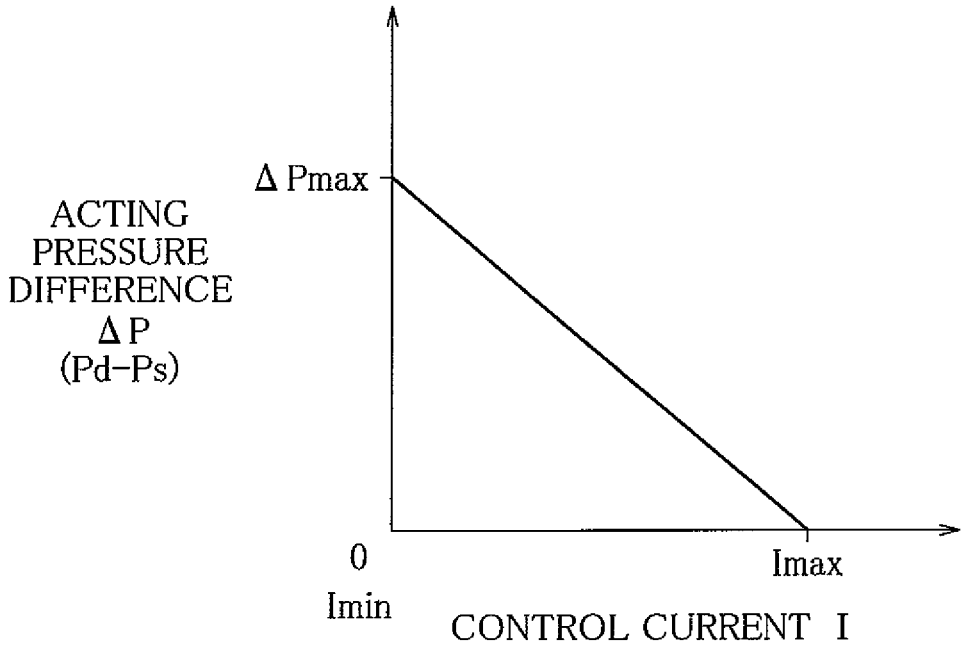
FIG. 5 is a graph showing a relationship between control current and acting pressure difference for the second embodiment.
Figure 6:
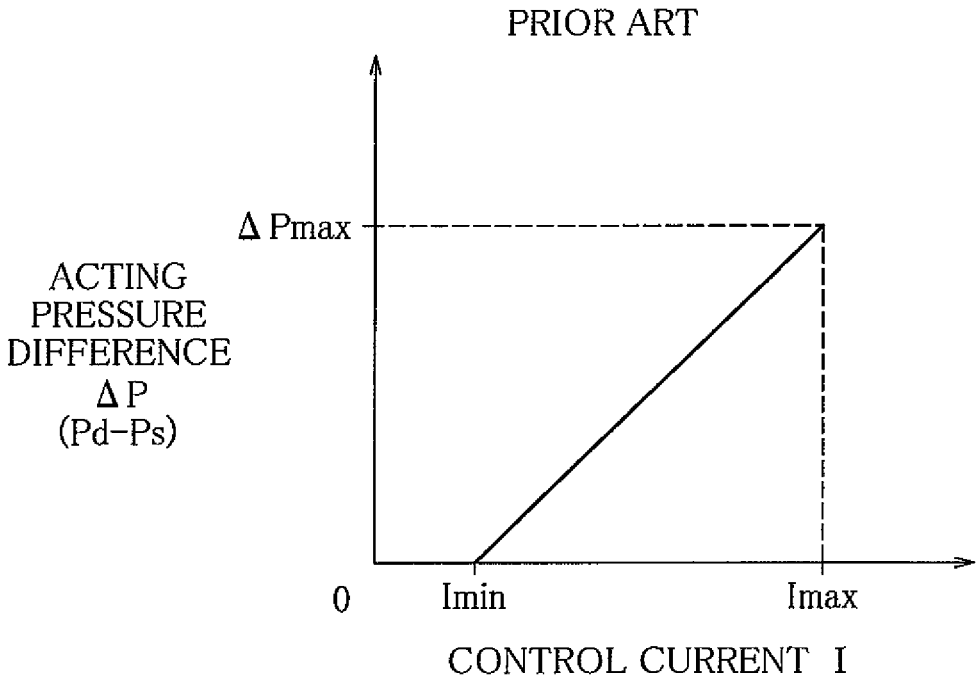
FIG. 6 is a graph showing a relationship between control current and acting pressure difference for prior art.

FIG. 5 is the graph showing the relationship between the control current I and the acting pressure difference ΔP represented by equation (8).

In contrast to the first embodiment, the present embodiment is arranged such that, with no current being supplied to the solenoid, the acting pressure difference takes a maximum value ΔPmax. As seen from FIG. 5, as the control current I is increased from 0, the acting pressure difference ΔP reduces, which is because the electromagnetic force acts in a valve opening direction. The acting pressure difference ΔP becomes 0 at a maximum value Imax of control current. This means that, like the displacement control valve 300, the displacement control valve 350 makes effective use of the electromagnetic force from its value 0, which makes the displacement control valve optimal for variable displacement compressors provided with an electromagnetic clutch.

Provided that the absolute value of discharge pressure Pd for a specified value of control current I is obtained, the value of suction pressure Ps can be obtained indirectly from equation (5) or (8). Consequently, if a discharge pressure detection means is provided in the air conditioning system to detect the discharge pressure Pd, the displacement control valve 300 or 350 can control the displacement to maintain the suction pressure Ps at a set value. Conversely, provided that the absolute value of suction pressure Ps for a specified value of control current I is obtained, the value of discharge pressure Pd can be obtained indirectly.

The present invention is not restricted to the above-described embodiments but can be altered in various ways.

For example, in the first embodiment, the valve element 302 and the solenoid rod 310 may be formed integrally.

In the first and second embodiments, the compression coil springs 303 and 314 or the compression coil 355 constitutes a urging means urging on the valve element 302 or 351 to hold the valve element 302 or 351 in the valve closing position when the solenoid is not being excited. The structure of the urging means is however not restricted to these. For example, it is possible to eliminate the compression coil spring 303, thus provide only the compression coil spring 314, or use three or more springs in combination to push on the valve element 302 in the valve closing direction. The urging means may include a spring of a type other than the compression coil spring.

It may be arranged such that the crank pressure Pc acts on the valve element 302 or 352. Further, the pressure sensing member may consist of a small bellows, in which case the valve element 302 is connected to an end of the bellows so that the discharge pressure Pd acts on the bellows, while the solenoid rod 310 is connected to an inner end face of the bellows into which the suction pressure Ps is introduced.

Further, the movable core 312 may be arranged with its outer circumferential surface in contact with the inner circumferential surface of the tubular member 313.

The compressor may be a variable displacement wobble-plate compressor or a variable displacement compressor driven by a motor. The present invention is also applicable to variable displacement compressors in which a restriction capable of varying the flow passage area or a restriction using a valve element controlled to open or close the flow passage is provided in the gas release passage 126.

The refrigerant is not restricted to R134a; carbon dioxide or other novel refrigerants may be used.

The invention claimed is:

1. A variable displacement compressor comprising:

a housing with a discharge pressure section, a suction pressure section, a crank chamber and cylinder bores defined inside, pistons fitted in the respective cylinder bores, a drive shaft rotatably supported inside the housing, a conversion mechanism including a swashplate variable in inclination and converting rotation of the drive shaft into reciprocating motion of the pistons, a displacement control valve opening and closing a first connection passage connecting the discharge pressure section and the crank chamber, and a restriction provided in a second connection passage connecting the crank chamber and the suction pressure section, where the stroke of the pistons is regulated by regulating the extent to which the displacement control valve is opened, thereby varying pressure in the crank chamber, wherein the displacement control valve includes:

a valve element having a discharge pressure receiving surface which receives pressure in the discharge pressure section and a suction pressure receiving surface which receives pressure in the suction pressure section acting in a direction opposite to the direction that the pressure in the discharge pressure section acts on the discharge pressure receiving surface, a solenoid generating an electromagnetic force acting on the valve element, and an urging means urging on the valve element in a valve closing direction to hold the valve element in a valve closing position when the electromagnetic force generated by the solenoid is not acting on the valve element, wherein when the electromagnetic force generated by the solenoid is not acting on the valve element, the first connection passage is opened or closed by the displacement control valve so as to maintain a pressure difference between the pressure in the discharge pressure section acting on the discharge pressure receiving surface and the pressure in the suction pressure section acting on the suction pressure receiving surface at a set value determined depending on a urging force exerted by the urging means, and wherein the variable displacement compressor is a clutchless compressor having a check valve arranged in the discharge pressure section, the check valve opens when a pressure difference across the check valve exceeds a set value and stays closed while the pressure difference is at or below the set value, and said set value of the pressure difference determined depending on the urging force exerted by the urging means is less than the set value of the pressure difference across the check valve.

2. The variable displacement compressor according to claim 1, wherein the electromagnetic force generated by the solenoid acts on the valve element in the valve closing direction.

* * * * *